United States Patent [19]

Speyer

[11] 4,010,902

[45] Mar. 8, 1977

[54] BLOW GUNS

[75] Inventor: Geoffrey Edward Speyer, Worcester, England

[73] Assignee: Taylor & Osborne Limited, Birmingham, England

[22] Filed: Nov. 3, 1975

[21] Appl. No.: 629,091

[30] Foreign Application Priority Data

Oct. 9,1975 United Kingdom..... 41459/75

[52] U.S. Cl. ..... 239/428.5; 124/73; 239/288; 239/587; 239/DIG. 2

[51] Int. Cl.[2] ..... B05B 1/28; B05B 1/30

[58] Field of Search ..... 124/73, 74, 75; 239/411, 459, 541, 577, 586, DIG. 22, 104, 105, 288, 288.3, 288.5, 428.5, 587, 599; 285/340; 137/377, 381

[56] References Cited

UNITED STATES PATENTS

| | | | |
|---|---|---|---|
| 2,950,132 | 8/1960 | Kocsuta | 285/340 X |
| 3,445,069 | 5/1969 | Druge | 239/586 X |
| 3,647,142 | 3/1972 | Drude et al. | 239/288.3 |
| 3,952,955 | 4/1976 | Clements | 239/288.5 |
| 3,963,180 | 6/1976 | Wagner | 239/288.5 |

FOREIGN PATENTS OR APPLICATIONS

| | | | |
|---|---|---|---|
| 1,255,329 | 12/1971 | United Kingdom | 239/577 |

*Primary Examiner*—Richard T. Stouffer

*Attorney, Agent, or Firm*—Marshall & Yeasting

[57] ABSTRACT

The blow gun comprises a hollow body having an inlet for compressed air at one end of the body. A tube extending from the other end of the body has a closed end mounted to swivel in the body, and has a radial port leading from the interior to the exterior of the tube adjacent to the closed end of the tube. A cap carried by the closed end of the tube is radially spaced from the periphery of the tube and shrouds the port. A seal is located in the body, surrounding the tube, on which the cap normally seats to prevent air from entering the port, but from which one side of the cap can be separated by swinging the tube out of axial alignment with the body, to admit air to the port. A nozzle fixed on the outer end of the tube has a Venturi passage extending outward from the tube, the inner end of such passage being radially spaced from the tube and having ports arranged laterally of the tube which act as inlets when air is discharged through the nozzle and as outlets when the nozzle is obstructed. A plurality of radial vanes on the periphery of the nozzle extend from the inner ends of the lateral ports substantially beyond the outer end thereof.

6 Claims, 3 Drawing Figures

BLOW GUNS

BACKGROUND OF THE INVENTION

This invention relates to blow guns which are used for example in manufacturing processes to clear metal shavings or swarf from drilled passages. Conveniently the gun is adapted to be connected to a source of compressed air and is arranged to be switched between "on" and "off" positions. It has been found that guns of this kind can be dangerous in that if the outlet nozzle contacts the operator's skin when the gun is "on" then high pressure air, for example of pressures of 100 pounds per square inch, may penetrate the skin.

SUMMARY OF THE INVENTION

The object of the invention is to provide a safe gun, capable of use with high pressure air, but in which obstruction of the outlet nozzle results in reduced pressure.

In accordance with the invention, a blow gun comprises an outlet nozzle and a supply passage leading from switch means, said passage extending through an area of the nozzle which is ported to atmosphere, whereby in normal use the passage acts as a venturi to draw ambient air through the ports for delivery through the nozzle but, if the nozzle is obstructed, the ports act as outlets to reduce pressure at the nozzle tip.

Preferably the passage is locked to the nozzle in a manner preventing unauthorised separation so as to prevent operatives removing the nozzle and using the passage alone in a dangerous way.

Figure 1:
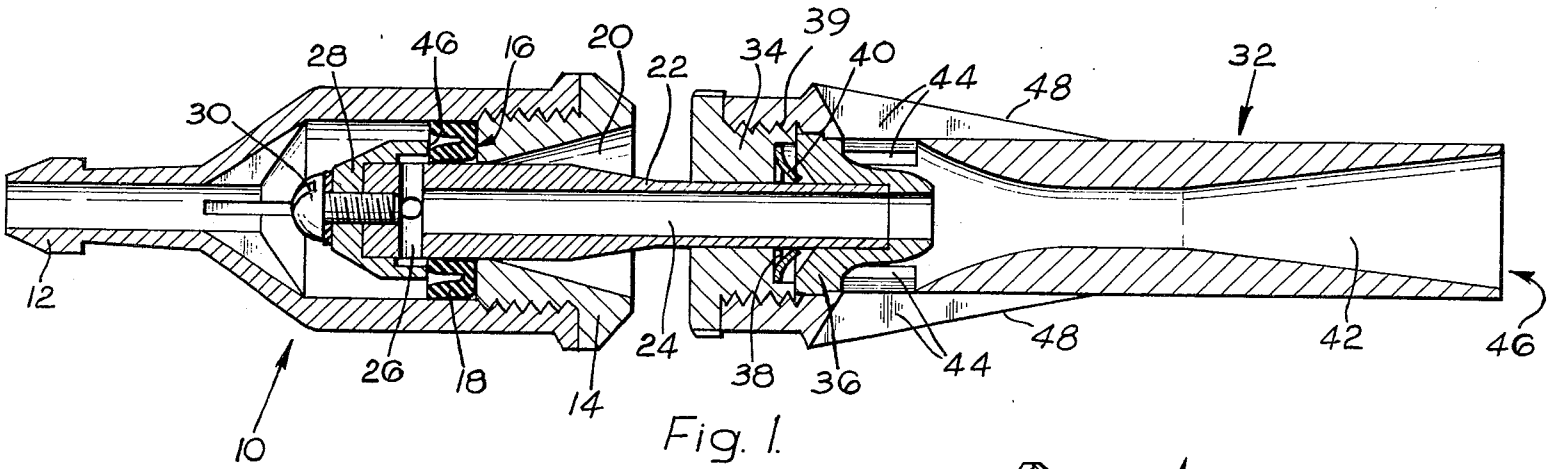
FIG. 1 is a longitudinal section of a gun assembly.

Referring now to the drawings, and particularly FIG. 1 thereof, the gun comprises a body 10 adapted for connection to a high pressure air line at 12 and having a plug 14 at its opposite end, the two parts being screwed together. The plug provides an internal shoulder 16 which accommodates a seal ring 18 which is annular and of Vee section with the Vee opening towards the inlet 12.

Located in the body and extending through a central flared bore 20 in the plug is a tube 22 bored with a supply passage 24 which opens through radial ports 26 behind the seal. A cap 28 is secured to the end of the tube within body 10 by screw 30. The cap shrouds the ports 26 and may seat on the seal engaging at least the inner lip of the same but without covering the groove between the lips. The tube is arranged so that it can tilt relative to the axis of the body and the shrouded portion of the cap then distorts the seal ring so that the latter departs from a truly circular and concentric configuration but the resilience of the seal (which may be of a suitable rubber composition) provides a restoring force tending to return the tube to the coaxial position with the body.

The gun also comprises a second body 32 forming an outlet nozzle. This second body has a plug 34 adjacent the first body, an insert 36 trapped in the body and a retaining clip 38 behind the insert and between the latter and the plug. The clip may be a spring washer of the kind having a continuous annular periphery and a series of radially inwardly extending fingers 40, made of a resilient material and of such a length that they are deflected as illustrated when the tube 22 is pushed through the washer to seat in the insert. This retains the assembly together and may prevent the body 32 being pulled off the tube 22. The body 32 is formed with a venturi passage 42 and has ports 44 opening through its wall at the side of the insert 34. Radial fins 48 on the body 32 extend from the inner ends of the ports 44 beyond the outer ends of such ports. The plug 34 is screwed into body 32 and the threads may be coated with adhesive 39 to prevent subsequent separation.

In use, with inlet 12 connected to the air line, the cap 28 acts as a piston and is moved to the illustrated position (FIG. 1) if the cap had been displaced axially away from the seal, and in this position the lips of the seal expand away from one another and because of the contact between the rim of the cap and the inner lip of the seal air cannot reach the ports 26. The gun is then effectively in an "off" position.

Figure 2:
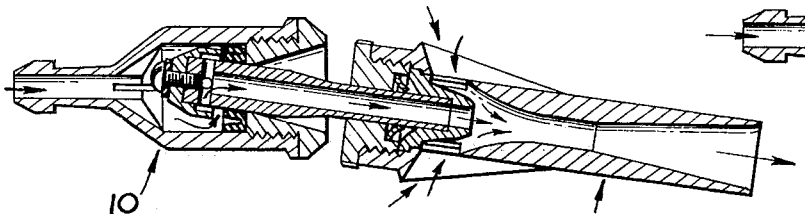
FIG. 2 is a somewhat diagrammatic view on a smaller scale showing the same in use.

If the tube 22 is then deflected from the co-axial position (FIG. 2), the separation of the rim of the cap from the seal opens a path for air therebetween and to enter the ports. The air flows through the passage 24 and via the venturi passage 42 to exit from the gun. The venturi effect sweeps in ambient air via ports 44. The arrows on FIG. 2 indicate the direction of air flow and the inflow through the ports 44.

Figure 3:
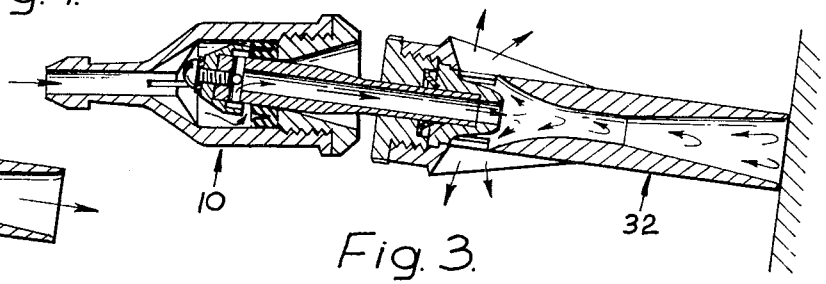
FIG. 3 also shows the same gun in use, but with the nozzle outlet blocked.

If the free end 46 of the venturi is blocked, as shown in FIG. 3, air exits via the ports 44, and the pressure at end 46 is substantially reduced. Return of the parts to the co-axial position switches the gun to the "off" position again.

Having now described our invention - what we claim is:

1. A blow gun comprising a hollow body having an inlet for compressed air at one end of the body, a tube extending from the other end of the body, said tube having a closed end mounted to swivel in the body, and further having radial port leading from the interior to the exterior of the tube adjacent to the closed end of the tube, a cap carried by the closed end of the tube which is radially spaced from the periphery of the tube and shrouds said port, a seal in the body, surrounding the tube, on which the cap normally seats to prevent air from entering said port, but from which one side of the cap can be separated by swinging the tube out of axial alignment with the body to admit air to said port, wherein the improvement comprises a nozzle fixed on the outer end of the tube, said nozzle having a Venturi passage extending outward from the tube, the inner end of such passage being radially spaced from the tube and having ports arranged laterally of the tube which act as inlets when air is discharged through the nozzle and as outlets when the nozzle is obstructed, and a plurality of radial vanes on the periphery of the nozzle which extend from the inner ends of the lateral ports substantially beyond the outer ends thereof.

2. A blow gun according to claim 1 comprising an assembly at the inner end of the Venturi passage having an inlet passage into which the outer end of the tube has a push-fit, a spring washer captively concealed in said assembly being arranged to receive and be deflected by the tube to lock the tube in said inlet passage.

3. A blow gun according to claim 2 wherein the assembly at the inner end of the Venturi passage comprises an annular threaded plug screwed into the inner end of the nozzle and cemented in place by an adhesive, to retain the spring washer.

4. A blow gun according to claim 1 comprising an assembly at the inner end of the Venturi passage having an inlet passage into which the outer end of the tube has a push-fit, said assembly comprising a tapered internal nozzle which forms the end of the inlet passage and which extends into the inner end of the Venturi passage and terminates downstream of said lateral ports, thus providing an annular passageway surrounding said tapered nozzle to direct the flow of air entering said lateral ports.

5. A blow gun according to claim 4 wherein a spring washer captively concealed in said assembly is arranged to receive and be deflected by the tube to lock the tube in said inlet passage.

6. A blow gun according to claim 5 wherein the assembly at the inner end of the Venturi passage comprises an annular threaded plug screwed into the inner end of the nozzle and cemented in place by an adhesive, to retain the spring washer.

* * * * *